United States Patent [19]

Bohan, Jr.

[11] 4,329,628

[45] May 11, 1982

[54] RELAXATION OSCILLATOR TYPE SPARK GENERATOR

[75] Inventor: John E. Bohan, Jr., Minneapolis, Minn.

[73] Assignee: Honeywell Inc., Minneapolis, Minn.

[21] Appl. No.: 174,084

[22] Filed: Jul. 31, 1980

[51] Int. Cl.[3] ..... H05B 37/02

[52] U.S. Cl. ..... 315/209 SC; 315/241 R; 361/256; 361/263; 431/264

[58] Field of Search ..... 315/209 SC, 209 R, 241 R; 361/256, 263; 431/264

[56] References Cited

U.S. PATENT DOCUMENTS

| | | | |
|---|---|---|---|
| 3,718,423 | 2/1973 | Matthews | 361/256 |
| 3,781,163 | 12/1973 | Ovens | 361/256 |
| 3,806,305 | 4/1974 | Dietz et al. | |
| 3,902,839 | 9/1975 | Matthews . | |
| 3,918,881 | 11/1975 | Matthews . | |
| 4,001,638 | 1/1977 | Bauer | 315/209 SC |
| 4,023,922 | 5/1977 | Goto | 361/256 |

*Primary Examiner*—Harold A. Dixon

*Attorney, Agent, or Firm*—Alfred N. Feldman

[57] ABSTRACT

A spark generator of the relaxation oscillator type operates on only one half of the cycle of the applied alternating current. By providing a gating circuit that triggers through a threshold switch means from a capacitor charge, it is possible to fire a silicon controlled rectifier on the same half cycle as the charging of an energy storage capacitor. The circuit can be operated by means of a diode and switch, or by an asymmetric current conducting element such as a silicon controlled rectifier.

8 Claims, 2 Drawing Figures

RELAXATION OSCILLATOR TYPE SPARK GENERATOR

BACKGROUND OF THE INVENTION

Relaxation type oscillators have been used extensively for generation of ignition sparks in various types of fuel burning equipment. Many times these devices are referred to as silicon controlled rectifier spark generators. These devices utilize a capacitor that is charged from a potential source and then rapidly discharged by the gating of a silicon controlled rectifier so that the discharged current flows through the primary winding of a step up or high voltage transformer. This type of spark generator has been used extensively in automobile ignitions, gaseous fuel burner ignition systems, and in oil burner ignition systems.

Typically a relaxation type of oscillator relies on a circuit that allows for the energy storage capacitor of the device to be charged on one half cycle of the applied alternating current, and then provides a gating signal or pulse on the reverse half cycle to discharge the capacitor. This type of spark generation has been very reliable and is inexpensive. The concept of charging the energy storage capacitor on one half cycle of the applied alternating current and then discharging it on the reverse half cycle has certain drawbacks and disadvantages that must be overcome. In this type of a device, line voltage transients are present on both half cycles of the applied voltage and they can seriously interfere with other equipment that is operated in conjunction with the spark generator. More specifically, if a relaxation oscillator type of spark generator is utilized with a rectification type of flame sensor, the transients of current in the system on both half cycles can interfere with or simulate the presence of flame when that is not desirable. Also, there are certain types of ultraviolet sensing systems that are operated with the ultraviolet sensor active on one half cycle and the spark generator active on the reverse half cycle. In this type of a system it is undesirable to have line transients present on both half cycles of operation of the device.

These deficiencies have been recognized by others and there are a few circuits which disclose charging of a capacitor for use in a relaxation oscillator type of spark generator on the same half cycle as the firing of the associated silicon controlled rectifier. These circuits are rather complex, costly, and in certain cases the circuitry does not provide a good driving signal for the silicon controlled rectifier. Certain of the prior art devices that have been used to operate an ignition device on the same half cycle of the operation of the device as the generation of spark tend to have a deficiency in the manner in which the silicon controlled rectifier is gated and this deficiency is known as "gate starvation". Gate starvation is a situation in which the rise of the gate potential is relatively slow and does not cleanly drive the associated silicon controlled rectifier into a full "on" condition in a short period of time.

SUMMARY OF THE INVENTION

The present invention is directed to a simple relaxation type of silicon controlled rectifier oscillator for generation of spark for fuel ignition. This simplified circuit utilizes a gating technique that allows for firing the silicon controlled rectifier on the same half cycle as the energy storage capacitor is charged. The gating circuit is designed so that a gating pulse is generated to overcome gate starvation. This circuit therefore overcomes the deficiency of the prior art devices in providing a simple, inexpensive, and reliable gating circuit that is capable of firing the silicon controlled rectifier on the same half cycle as the charging of the energy storage capacitor. The device that results from the present invention makes the application of this particular spark generator readily available in circuits that utilize flame rectification and ultraviolet sensing without interference from the spark generator in critical sensing functions.

DESCRIPTION OF THE PREFERRED EMBODIMENTS

Figure 1:
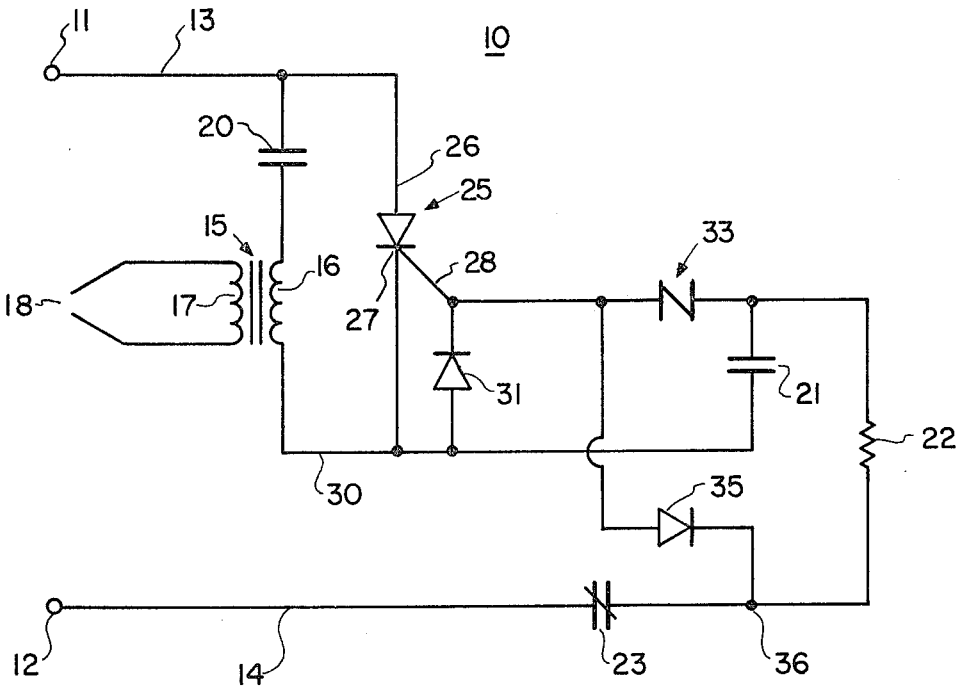
FIG. 1 is a schematic diagram of a spark generator controlled by a switch and a diode.

A spark generator is disclosed in FIG. 1 that is adapted to be connected to a conventional source of alternating current and a spark gap which is placed in position for ignition of fuel. Typically the spark generator disclosed in FIG. 1 at 10 would be energized from an alternating current source of voltage connected to terminals 11 and 12 which are in turn connected to a pair of conductors 13 and 14 which energize the spark generator 10. A spark generator transformer means is generally disclosed at 15 and includes a primary winding 16 and a high voltage secondary winding 17. The secondary winding typically would provide a voltage in the order of 15,000 volts and would be applied to a spark gap disclosed at 18. The spark gap 18 would be placed in a fuel burner, such as a residential furnace, so that the spark gap 18 would be positioned to ignite the pilot gas supplied to the furnace. The spark gap 18 could be utilized to ignite any fuel dependent upon the voltage and power available.

The primary winding 16 is connected to a pair of capacitors 20 and 21 that are connected in a series circuit between the input conductors 13 and 14. In this particular embodiment, a current limiting impedance 22 and a normally closed relay contact 23 are further connected in this series circuit. The relay contact 23 can be operated in conjunction with burner equipment to turn off the spark generator 10, in a well known and conventional manner.

The capacitor 20 is an energy storage capacitor that is used to generate the high voltage spark at the gap 18. The capacitor 20 and the primary winding 16 are shunted by a solid state switch means 25, disclosed as a silicon controlled rectifier. The silicon controlled rectifier 25 has an anode connection 26 and a cathode connection 27 along with a gate means 28. The solid state switch means 25 is connected in parallel with the energy storage capacitor 20 and the primary winding 16 by means of the anode 26 being connected to the conductor 13, while the cathode 27 is connected to a further conductor 30 that is common with the primary winding 16. The conductor 30 further is connected by means of a diode 31 to the gate means 28 of the silicon controlled rectifier 25.

The conductor 30 completes a gating circuit by connecting the capacitor 21 and a threshold switch means 33 to the gate means 28. The threshold switch means 33 typically would be a silicon bilateral switch which acts as a threshold switching element in a well known manner. The circuit of the spark generator disclosed in FIG. 1 is completed by the connection of a diode 35 between the gate means 28 and a point 36 that is between the normally closed relay contact 23 and the current limiting impedance 22. The current limiting impedance 22 could be a simple resistor, or could be any other type of current limiting impedance.

OPERATION OF FIG. 1

If it is assumed that a spark is desirable from the spark generator 10, the relay contact 23 will be closed and an alternating current will be applied between the terminals 11 and 12. When the voltage is going positive on conductor 13 with respect to conductor 14, a charging path can be traced through the capacitor 20, the primary winding 16, the conductor 30, the diode 31, and the diode 35 through the closed contact 23 to the conductor 14. The energy storage capacitor 20 will take on a charge until the applied voltage between the terminals 11 and 12 reaches its peak (which is the 90 degree point in the applied wave form). As soon as the voltage begins to decrease, the voltage on the capacitor 20 becomes slightly larger than the applied line voltage and the capacitor 20 starts to drive current through the source connected between terminals 11 and 12. This current flows through the normally closed contact 23, the impedance 22 and begins to charge the capacitor 21 in a polarity which would be positive at the switch means 33 with respect to the cathode 27. After a short period of time, that is a few degrees of the applied alternating current voltage wave form beyond the 90 degree point, the charge on capacitor 20 becomes sufficiently large to break down the threshold switching means or bilateral switch means 33. The charge on capacitor 21 is then discharged rapidly through the gate means 28 of the silicon controlled rectifier 25 into the cathode 27 and back to the conductor 30. This discharge causes the silicon controlled rectifier 25 to be driven cleanly and completely into conduction. The charge on capacitor 20 is discharged rapidly through the silicon controlled rectifier 25 where it flows via the conductor 30 through the primary winding 16 to complete the discharge of the capacitor 20. This discharge generates a high voltage spark at gap 18 by means of the step up transformer 15. This all occurs before the 180 degree point of the applied alternating current wave form. As thus can be seen, the storage capacitor 20 is charged and discharged during one half cycle of the alternating applied current on terminals 11 and 12.

When the polarity on the terminals 11 and 12 reverses so that terminal 12 becomes positive with respect to terminal 11, the capacitors 20 and 21 take on a reverse charge, but there is no gating circuit path for discharge of the stored charge through the primary winding 16. The second half of the cycle, that is the 180 to 360 degree portion, is thus bypassed as far as operation of the spark generator is concerned. Upon the terminal 11 becoming positive with respect to terminal 12 once again, the spark generator 10 prepares for the generation of another spark at the gap 18.

The present arrangement provides for a very simple means of providing both the charge and the discharge on the same one half cycle, and accomplishes it by driving the gate means 28 of the silicon controlled rectifier 25 in a sharp "on" manner so as to avoid any possibility of gate starvation of the silicon controlled rectifier.

Figure 2:
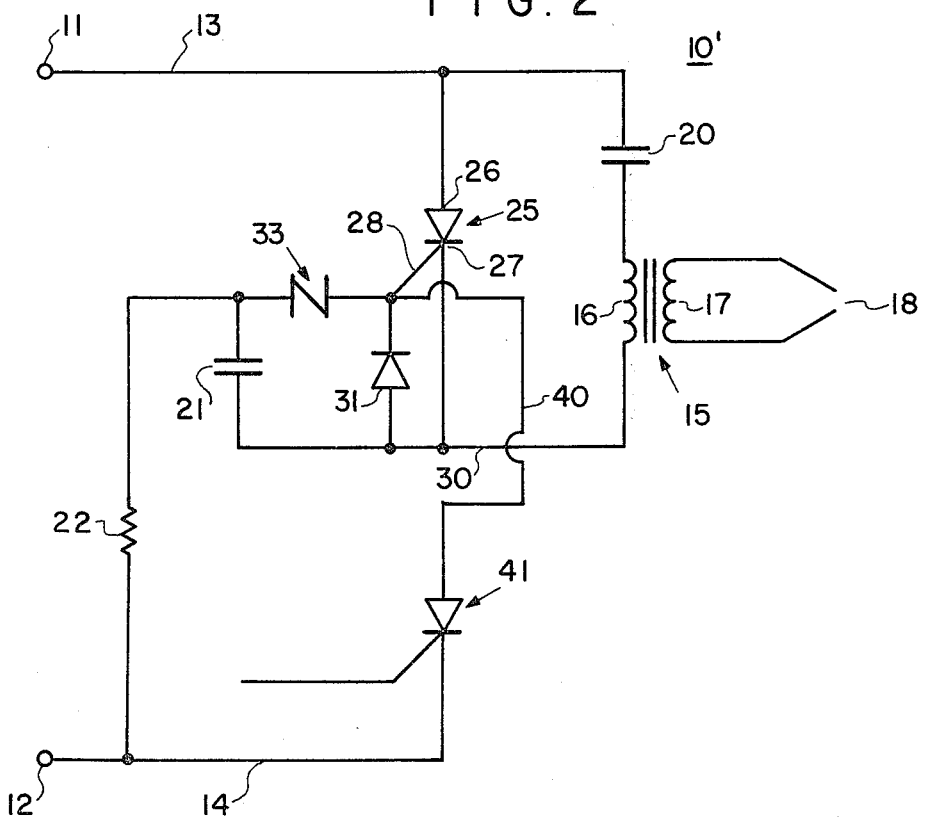
FIG. 2 is a schematic diagram of a spark generator controlled by a silicon controlled rectifier.

In FIG. 2 a slight variation of the spark generator of FIG. 1 is disclosed. In FIG. 2 a spark generator 10' is disclosed and all of the same components have the same reference numbers to correspond to FIG. 1. The spark generator 10' utilizes a conductor 40 and a silicon controlled rectifier 41 in place of the diode 35 and the normally closed switch 23 of FIG. 1. The silicon controlled rectifier 41 acts both as an asymmetric current conducting means and as the switch means for the low impedance charging path for the energy storage capacitor 20. In operation the circuits are identical except that the silicon controlled rectifier 41 and the spark generator 10' must be conductive in its asymmetric current conducting mode to supply the same function as the diode 35 and the closed switch 23 of FIG. 1. It thus can be seen that by a slight modification of the circuit disclosed in FIG. 1, a solid state control of a spark generator can be accomplished by adding a silicon controlled rectifier 41 in the place of the low impedance charging diode 35 of FIG. 1.

The present invention provides for a very simple, inexpensive and effective way of generating a spark for ignition where the charging of the energy storage capacitor and its discharge always occur on the same half cycle. As can be seen by the slight modification of FIG. 2 over FIG. 1, there are variations available in the present invention and the applicant wishes to be limited in the scope of his invention solely by the scope of the appended claims.

The embodiments of the invention in which an exclusive property or right is claimed are defined as follows:

1. A spark generator, including: spark generator transformer means having a primary winding and a high voltage secondary winding with said secondary winding adapted to be connected to a spark gap for ignition of a fuel; a pair of input conductors for said spark generator wherein said spark generator is adapted to be connected to an alternating current potential source; a pair of capacitors and said transformer primary winding connected in a series circuit between said pair of conductors; a first of said capacitors being an energy storage capacitor for said spark generator and a second of said capacitors being a gating control capacitor for said spark generator; solid state switch means having current carrying circuit means, and said switch means including gate means to control said switch means; said current carrying circuit means being connected in parallel circuit with said energy storage capacitor and said primary winding; threshold switch means and a diode connected to said gate means and forming a gating circuit which is in a shunt circuit with said gating control capacitor; said diode including connection means to further connect said diode between said gate means and said current carrying circuit means; and asymmetric current conducting means connected to said gate means and one of said conductors to provide a low impedance charging path for said energy storage capacitor.

2. A spark generator as described in claim 1 wherein said solid state switch means is a silicon controlled rectifier; and said current carrying circuit means is the anode-cathode circuit of said silicon controlled rectifier.

3. A spark generator as described in claim 2 wherein said threshold switch means is a bilateral solid state switch.

4. A spark generator as described in claim 3 wherein said series circuit connecting said capacitor and said primary winding to said pair of input conductors further includes a current limiting impedance.

5. A spark generator as described in claim 4 wherein said asymmetric current conducting means includes a silicon controlled rectifier to control the operation of said spark generator.

6. A spark generator as described in claim 4 wherein said asymmetric current conducting means includes a second diode and switch means to control the operation of said spark generator.

7. A spark generator as described in claim 6 wherein said first diode is connected between said gate means and said cathode of said silicon controlled rectifier.

8. A spark generator as described in claim 5 wherein said first diode is connected between said gate means and said cathode of said first silicon controlled rectifier.

* * * * *